US006432514B1

(12) United States Patent
Kobayashi et al.

(10) Patent No.: US 6,432,514 B1
(45) **Date of Patent: *Aug. 13, 2002**

(54) HEAT-BONDABLE INK-JET RECORDING MEDIUM

(75) Inventors: Motokazu Kobayashi, Yokohama; Masako Ichioka, Tokorozawa, both of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/126,424

(22) Filed: Jul. 30, 1998

(30) Foreign Application Priority Data

Aug. 1, 1997 (JP) ..... 9-219738

(51) Int. Cl.[7] ..... B41M 5/00
(52) U.S. Cl. ..... 428/195; 442/67

(58) Field of Search ..... 428/195, 346, 428/354, 355 R; 442/101, 304, 67

(56) References Cited

U.S. PATENT DOCUMENTS 5,501,902 A 3/1996 Kronzer ..... 428/323

FOREIGN PATENT DOCUMENTS

| | | |
|---|---|---|
| EP | 0 605 840 A2 | 7/1994 |
| EP | 0 673 779 A1 | 9/1995 |
| JP | 7-292581 | 11/1995 |
| JP | 8-218279 | 8/1996 |

*Primary Examiner*—Bruce H. Hess
(74) *Attorney, Agent, or Firm*—Fitzpatrick, Cella, Harper & Scinto

(57) ABSTRACT

Provided is a heat-bondable ink-jet recording medium comprising a base sheet having an ink-receiving layer, and, on one face thereof, an adhesive layer having a melting point of not higher than 110° C. as measured by DSC and a melt viscosity of not lower than 10,000 cP within a temperature range of from 120 to 170° C.

5 Claims, 1 Drawing Sheet

HEAT-BONDABLE INK-JET RECORDING MEDIUM

BACKGROUND OF THE INVENTION

1. Field of the Invention

The present invention relates to a recording medium used in an ink-jet recording system to conduct recording by ejecting ink droplets. More specifically, the present invention relates to a heat-bondable ink-jet recording medium which can be heat-bonded onto an adherend article, after a recorded image is formed thereon by ink-jet recording.

2. Related Background Art

Ink-jet recording conducts recording of images and characters by ejecting ink droplets by a variety of methods onto a recording medium like a paper sheet. Ink-jet recording has many advantages of high-speed printing with less noise generation, ease of multi-color printing, adaptability to variation of recording patterns, and needlessness of operation of latent image development and image fixation. Therefore, ink-jet recording is rapidly becoming popular in various application fields such as recording of patterns including characters, and color images. With the diversification of needs, ink-jet-printed paper sheets or films are coming increasingly to be used for labels and emblems. Labels, which can be bonded onto various adherend articles in simple operation, are used generally in many application fields.

New applications are being developed in which the features of the labels and the features of the ink-jet recording medium for simple image-formation are combined. For example, cloths readily dyeable by ink-jet printing have been developed as the ink-jet recording medium. Such cloths are required increasingly to be made suitable for use for emblems, and to be workable readily domestically for displaying numbers such as players' numbers, and uniform numbers, displaying names, and displaying characters and images for advertisement. Such cloths may contain a cationic substance or a nonionic surfactant to prevent discoloration in washing or other treatment after the printing, as disclosed in Japanese Patent Application Laid-Open Nos. 7-292581 and 8-218279.

In order to make emblems, however, by bonding a recording medium for an ink-jet system on a cloth or the like, after characters or images are formed on the recording medium, it is necessary to sew it to the cloth, or to bond it thereto by an adhesive. This requires much labor. Otherwise, a hot-melt adhesive layer is formed preliminarily on the cloth. Although the hot-melt adhesive layer can be also provided on the cloth mentioned above in advance, a relation between thermal characteristics and a thickness of the hot-melt adhesive layer has not been considered at such a conventional cloth as heat-bondable recording materials. Consequently, there has been brought such disadvantages, that the cloth cannot be conveyed when printing is conducted using an ink-jet printer and that high quality images cannot be obtained due to lowering of an ink-absorbency of an ink-receiving layer and flowing or running of the ink on the recording medium, and also that sufficient adhesion between the cloth and the hot-melt adhesive layer cannot be obtained, and the emblem cloth may be frayed from its end or may be peeled when washing.

SUMMARY OF THE INVENTION

The object of the invention is to provide a highly durable heat-bondable ink-jet recording medium which enables formation of a high-quality image by ink-jet printing without flowing or running of ink, capable of forming strong heat-bonding onto an adherend article domestically, and causing no fray of the cloth end or peeling of the label or emblem from the cloth after bonding during use.

The above object can be achieved by the present invention described below.

According to the present invention there is provided a heat-bondable ink-jet recording medium comprising a base sheet having an ink-receiving layer and, on one face thereof, an adhesive layer having a melting point of not higher than 110° C. as measured by DSC, and a melt viscosity of not lower than 10,000 cP within a temperature range of from 120 to 170° C.

DESCRIPTION OF THE PREFERRED EMBODIMENTS

After comprehensive studies to solve the aforementioned problems of the prior art, the inventors have found that a hot-melt adhesive layer may involve disadvantages shown below depending on the thermal properties thereof.

First, if a melting point is higher than 110° C., the hot-melt adhesive layer is not sufficiently melted and the adhesive layer cannot be entered into the fibers of a cloth and the like which will become a heat-bondable recording medium, so that strong adhesion cannot be obtained when the hot-melt adhesive layer is heat-bonded onto the adherend article. For example, an emblem type of heat-bondable medium with such an adhesive layer may be exfoliated or peeled off during use.

Second, if a melt viscosity within the temperature range of from 120 to 170° C. is lower than 10,000 cP, the hot-melt adhesive layer will flow to penetrate into the cloth fibers to weaken the adhesion, when, for example, a heat-bondable medium of an emblem shape is bonded onto a cloth by heating with a domestic heating iron or the like, so that a hot-melt adhesive layer may cause fraying of the end portion of the emblem or exfoliation thereof. Further, if a melt viscosity of the hot-melt adhesive layer is lower than 10,000 cP, it is difficult to keep a thickness of the hot-melt adhesive layer uniform on a surface of the base sheet at the production. Also a material of the hot-melt adhesive layer may penetrate into the interior of the base sheet, when producing the heat-bondable ink-jet recording medium by laminating the hot-melt adhesive layer onto the base sheet and then press-bonding them by heating, thereby impairing the ink absorbency of the base sheet so that flow or running of ink may be caused to result in lower quality of the formed image in ink-jet recording.

The present invention has solved the aforementioned problems and provided a heat-bondable ink-jet recording medium which enables formation of high-quality images by ink-jet printing and is suitable for labels and emblems to be heat-bonded firmly onto various adherend articles by simple domestic operation, by making thermal characteristics of the hot-melt adhesive layer optimum.

Figure 1:
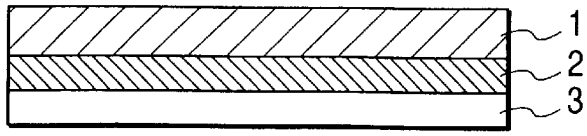
FIG. 1 illustrates a schematic sectional view of an example of the heat-bondable ink-jet recording medium of the present invention.

FIG. 1 illustrates schematically a heat-bondable ink-jet recording medium of the present invention having the above excellent properties. The heat-bondable ink-jet recording medium of the present invention is constituted basically of a base sheet 1, and a hot-melt adhesive layer 2 formed on the base sheet 1, and optionally a release paper 3 formed on the hot-melt adhesive layer 2. The respective materials are described below.

The base sheet 1 constituting the heat-bondable ink-jet recording medium of the present invention is not limited, provided that it has sufficient heat resistance durable to heat in production, and is suitable for ink-jet recording. Specifically, the material for the base sheet is for example paper sheets, films, and cloths woven from natural fibers, synthetic fibers, or mixed fibers thereof. In particular, cloths woven from natural fibers, synthetic fibers, or mixed fibers thereof are preferred as the base sheet of the heat-bondable ink-jet recording medium of the present invention, specifically including cloths woven from fibers of cotton, wool, silk, nylon, rayon, and the like. The cloths in the present invention includes at least cloths and nonwoven fabrics.

The base sheet useful in the present invention has an ink-receiving layer having a high ink absorbency for excellent image formation, water-fastness to hold the image formed thereon against washing and other treatment, and sufficient durability. The ink-receiving layer can be formed by a conventional method by use of a dye-fixing agent or the like. The dye-fixing agent is preferably an ionic substance, more preferably a cationic substance (cationizing agent) to prepare an ink-receiving layer of excellent characteristics. The formation of the ink-receiving layer by use of the cationic substance may be conducted by immersing the base sheet into a treatment liquid (composition) containing the dye-fixing cationic substance to form the ink-receiving layer on the entire base sheet of cloth or the like, or the composition may be applied on one face of the base sheet to form the ink-receiving layer on the one surface, as described in Japanese Patent Application Laid-Open Nos. 7-292581 and 8-218279.

The ionic substance useful in the present invention includes primary, secondary, and tertiary amine salts type compounds such as hydrochlorides and acetates of laurylamine, coconut amine, stearylamine, and rosin amines; quaternary ammonium salts type compounds such as lauryltrimethylammonium chloride, lauryldimethylbenzylammonium chloride, benzyltributylammonium chloride, and benzalkonium chloride; pyridinium salts type compounds such as cetylpyridinium chloride, and cetylpyridinium bromide; imidazoline type cationic compounds such as 2-heptadecenylhydroxyethylimidazoline; and ethylene oxide adducts of higher alkylamines such as dihydroxyethylsteraylamine.

Polymeric cationic substances may be used as an ionic substance, including water-soluble cationic polymers such as polyallylamine salts, polyallyl sulfones, dimethyldiallylammonium chloride, polyamine sulfonate, polyvinylamine salts, and the like. The useful cationic substance is not limited thereto. The cationic substance is applied to the base sheet in an amount ranging preferably of from 0.05 to 20 $g/m^2$, more preferably from 1 to 10 $g/m^2$.

The heat-bondable ink-jet recording medium of the present invention may contain porous inorganic particles in the ink-receiving layer to enhance further the ink absorbency. Example of the porous inorganic particles includes silica, alumina, calcium carbonate, magnesium carbonate, magnesium oxide, talc, and clay.

A binder resin may be added to the treatment liquid (composition) for formation of the ink-receiving layer of the base sheet in the present invention in such a range, so far as an absorption of the ink applied from an ink-jet printer is not retarded and hand of the base sheet is not adversely affected. Examples of the binder resin include polyvinyl alcohols; modified polyvinyl alcohols; polyacrylamides; polyvinyl acetates; oxidized starch; etherified starch; cellulose derivatives such as carboxymethyl cellulose, and hydroxyethyl cellulose; casein; gelatin; soybean protein; maleic anhydride resins; latexes of conjugated diene type copolymers such as styrene-butadiene copolymer, and methyl methacrylate-butadiene copolymer; latexes of acrylic polymers such as polymers and copolymers of acrylate esters and methacrylate esters; latexes of vinyl polymers such as ethylene-vinyl acetate copolymers; latexes of above polymers modified at the functional group like carboxyl; synthetic resin type binders such as vinyl chloride-vinyl acetate copolymers, polyvinyl butyral resins, and alkyd resins; and ion-modified resins thereof. The binder resin may be used singly or in combinations of two or more thereof.

The treatment liquid (composition) for formation of the ink-receiving layer in the present invention may contain a surfactant. Examples of the surfactant include anionic surfactants such as carboxylate salts, sulfonate salts, sulfate ester salts, and phosphate ester salts; cationic surfactants such as aliphatic amine salts, aliphatic quaternary ammonium salts, aromatic quaternary ammonium salts, and heterocyclic quaternary ammonium salts; ether type nonionic surfactants such as polyoxyethylene alkyl ethers, polyoxyethylene alkyl phenyl ethers, polyoxyethylene-polyoxypropylene block copolymers; ether-ester type nonionic surfactants such as polyoxyethylene-glycerin fatty acid esters, and polyoxyethylene-sorbitan fatty acid esters; ester type nonionic surfactants such as polyethyleneglycol fatty acid esters, sorbitan fatty acid esters, and sucrose fatty acid esters; nitrogen-containing nonionic surfactants such as polyoxyethylene fatty acid amides, and polyoxyethylene-alkylamines; and amphoteric surfactants such as betaine, aminocarboxylic acid salts, and imidazoline derivatives.

The treatment liquid (composition) containing the above materials may be in a state of a solution in water or an organic solvent or a liquid dispersion of fine particles depending on the properties of the material used. As mentioned above, the treatment liquid (composition) may be applied on one face of a base sheet to form the ink-receiving layer on the surface of the one face thereof, or the base sheet may be immersed into the treatment liquid to make an ink-receiving layer in the entire base sheet.

In the heat-bondable ink-jet recording medium of the present invention, the hot-melt adhesive layer 2 to be laminated on one face of the base sheet 1 having an ink-receiving layer of the aforementioned constitution is constituted of a material having a melting point measured by DSC of not higher than 110° C., and a melt viscosity of not lower than 10,000 cP within the temperature range of from 120 to 170° C. The melting point measured by DSC herein means a maximum peak temperature of melting as measured by a Differential Scanning Calorimeter (DSC) at a temperature rising rate of 10° C./min.

As mentioned above, in the present invention, if a melting point measured by DSC of the hot-melt adhesive layer is higher than 110° C., the hot-melt adhesive layer will not sufficiently be melted in operation of heat-bonding of the hot-melt adhesive layer onto an adherend article by bringing the heat-bondable ink-jet recording medium into close contact thereto. Thus, for example, when an adherend article is heat-bonded to a label or an emblem made from a heat-bondable ink-jet recording medium, there may be a case that the label or emblem is liable not to be bonded sufficiently and may be peeled off during use.

Further, if a melt viscosity is lower than 10,000 cP within the temperature range of from 120 to 170° C. of the hot-melt adhesive layer, the hot-melt adhesive layer is liable, after melting of the hot-melt adhesive layer in heat-bonding to an adherend article like a cloth using a house hold iron as a heat source, to flow out into interspace of the fibers of the cloth to weaken the bonding strength, which may cause peel off of the label or the emblem or fraying of the fibers at the end of the emblem or the like.

Furthermore, if a melt viscosity is lower than 10,000 cP within the temperature range of from 120 to 170° C. of the hot-melt adhesive layer, in operation of lamination of the hot-melt adhesive layer by hot-pressing on the base sheet in production of the heat-bondable ink-jet recording medium of the present invention, the material of the hot-melt adhesive layer tends to penetrate into the interior of the base sheet to impair the ink absorbency of the ink-receiving layer, which may cause flow or running of ink in ink-jet recording to impair the image quality.

For formation of the hot-melt adhesive layer 2 having the aforementioned desired properties, a thermoplastic resin is preferably employed as the main material thereof. Examples of the thermoplastic resin include polyester resins, acrylic resins, vinyl chloride-vinyl acetate type resins, styrenic resins, ethylene-vinyl acetate resins, olefin resins, vinylbutyral resins, polyamide type resins, propylene resins, polyethylene oxide type resins, vinylidene chloride resins, nylon resins, rubber type resin, and reactive hot-melt type resins. These thermoplastic resins have preferably an MFR (melt flow rate, defined in JIS K 6760) of not higher than 80.

The hot-melt adhesive layer 2 can be formed on one face of the base sheet by application of the thermoplastic resin in a hot-melted state, in a solution state, or in an liquid emulsion state.

The adhesiveness of the hot-melt adhesive layer 2 can be improved by addition of a modifier, such as a viscosity builder, a plasticizer, an oil, a wax, and a filler, together with the thermoplastic resin to the coating liquid in the present invention. Another additive such as an antioxidant, a UV absorber, a dye, and a pigment may be added thereto. The total content of the modifier and the additive is preferably not more than 75% by weight of the total amount of the materials constituting the hot-melt adhesive layer. With the total content thereof higher than 75% by weight, the adhesiveness of the hot-melt adhesive layer 2 is lowered undesirably.

The thickness of the hot-melt adhesive layer 2 formed as above on the base sheet 1 ranges preferably from 30 to 120 $\mu$m. By making it larger than 30 $\mu$m, there can be brought an effect to suppress a function that the base sheet may shrink due to absorbing an ink when printing is conducted with an ink-jet printing system, so that problems at printing, such as image blurring or curling of the sheet, can be avoided. If the thickness is smaller 30 $\mu$m, sufficient adhesive strength necessary for adhering the base material with fibers of a cloth of the heat-bondable recording material cannot be obtained, so that the hot-melt adhesive layer does not have sufficient adhesiveness, causing exfoliation of the bonded portion or fraying of the end portion of the heat-bonded adherend article formed as described later by adhesion with the hot-melt adhesive layer. On the contrary, if the thickness is larger than 120 $\mu$m, there may be caused a problem of conveyability in a printer when it is used as a medium for an ink-jet recording system, because a flexibility of the whole heat-bondable recording medium will be decreased. Also, heat conductivity is decreased, so that heat is not transferred completely to a contact surface between the hot-melt adhesive layer and an adherend article, and the adhesive layer will not be entered into the adherend article. As a result, there may be a problem that strong adhesion cannot be obtained.

The heat-bondable ink-jet recording medium of the present invention is preferably provided with a release paper 3 as shown in FIG. 1 on the hot-melt adhesive layer 2 formed as above for convenience of production and use. The material of the release paper is not limited, as far as it is resistant to heating during the production and is releasable readily before the heat-bonding. The material may be paper sheets, plastic films, and cloths woven from natural fiber or synthetic fiber. The release paper 3 made of the above material is preferably treated for releasability at the face to be brought into contact with the hot-melt adhesive layer to form a releasing face by application of a silicone, a wax, a resin, or the like.

The heat-bondable ink-jet recording medium of the present invention may be produced in the manner as described below.

In one method, a hot-melt adhesive layer is formed on a releasing face of a release sheet; a base sheet having an ink-receiving layer is superposed on the hot-melt adhesive layer; and then the hot-melt adhesive layer and the base sheet are press-bonded to unify the release sheet, the hot-melt adhesive layer, and the base sheet. In another method, a hot-melt layer forming material (e.g., a hot-melt adhesive in a film shape) is superposed on a base sheet; a releasing face of a release sheet is brought into contact with the hot-melt layer forming material; and the superposed matter is press-bonded to unify the release sheet, the hot-melt adhesive layer, and the base sheet. In any of the above methods, heat is preferably applied in the press-bonding to improve the adhesion between the hot-melt adhesive layer and the base sheet.

The heat-bondable ink-jet recording medium of the present invention produced as above is used as below to form an ink-jet recorded image on a variety of adherend articles.

Figure 2A:
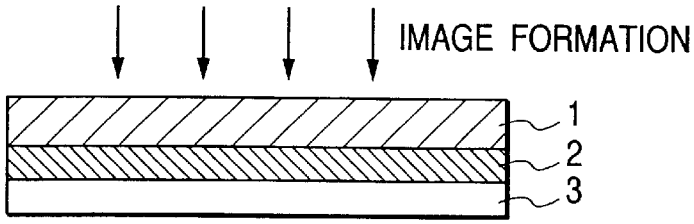
FIGS. 2A, 2B, 2C, 2D and 2E illustrate an example of a process for bonding the heat-bondable ink-jet recording medium onto an adherend article.
Figure 2B:
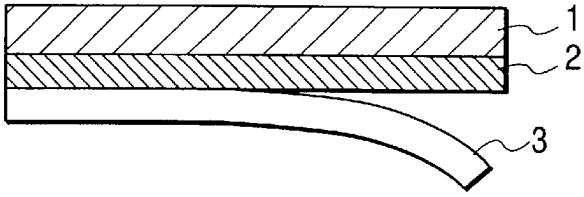
Figure 2C:
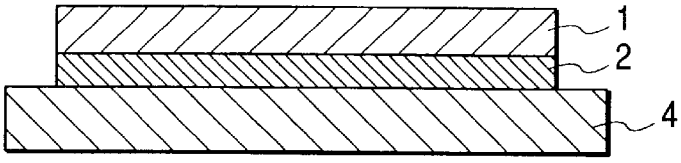
Figure 2D:
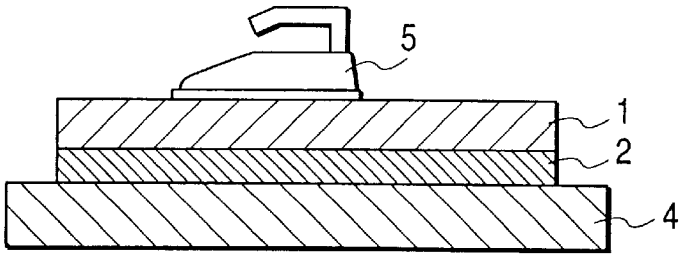
Figure 2E:
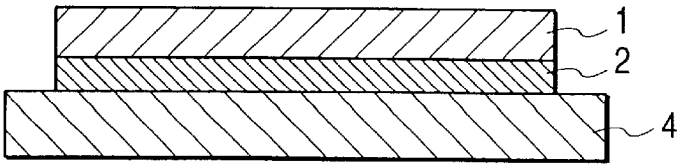

In the image bonding method according to the present invention, an image such as characters, symbols, or diagrams is firstly formed on the face of the heat-bondable base sheet 1 of the heat-bondable ink-jet recording medium of the present invention by a conventional ink-jet printer as shown in FIG. 2A. In FIGS. 2A to 2E, reference numerals 2 and 3 are a hot-melt adhesive layer and a release paper, respectively. The release paper 3 is peeled off from the heat-bondable ink-jet recording medium carrying an image as shown in FIG. 2B to bare the hot-melt adhesive layer 2. The bared hot-melt adhesive layer 2 is brought into close contact with an adherend article 4 as shown in FIG. 2C. As shown in FIG. 2D, heat is applied from the side of the heat-bondable ink-jet recording medium (or alternatively from the side of the adherend article to receive the image) by a heat source 5 (a domestic pressing iron in FIG. 2D) for a prescribed time to heat-bond the hot-melt adhesive layer 2 to the adherend article 4. Consequently, the base-sheet 1 having the ink-jet recorded image is heat-bonded firmly through the hot-melt adhesive layer 2 on the adherend article 4 of a variety of materials and shapes as shown in FIG. 2E. Thereby, an ink-jet recorded image can be transferred onto an adherend article by a simple procedure.

The adherend article used in the heat-bonding method is not limited in the present invention, as far as it is not deformed nor discolored in the heat-bonding process. Specifically, examples of the adherend article include cloths composed of natural fibers or synthetic fibers or mixed fibers thereof, paper sheets, resin films, molded articles constituted of wood, tiles, synthetic resins, and metals. In particular, in the present invention, suitable adherend articles includes cloths made from cotton, mixed fibers of cotton with a synthetic resin fiber such as a polyester.

The heat source used for the heat-bonding method of the present invention may be any of conventional ones, including pressing irons, hot plates, hot rolls, hot presses, and heat vacuum applicators (HVA). The heat-bonding temperature is not limited, so far as the adherend article to which the image is formed is not deformed, discolored, or scorched. In practice, the heat-bonding temperature is in the range preferably of from 120 to 250° C., more preferably from 130 to 250° C. In the heat-bonding process, the conditions of the pressure applied to the bonding article and the pressing time are not limited, so far as the hot-melt adhesive layer is bonded tightly to the adherend article without deformation, and discoloration. In practical bonding of the present invention, at the aforementioned temperature, the pressure ranges preferably from 10 g/cm$^2$ to 1 kg/cm$^2$, and the pressing time ranges preferably from 5 seconds to 2 minutes.

The present invention is described below in more detail by reference to Examples without limiting the invention thereto in any way. Table 1 shows collectively the melting points measured by DSC and the melt viscosity in the range of from 120 to 170° C. of the hot-melt adhesive layers of the respective heat-bondable ink-jet recording medium.

EXAMPLE 1

A coating liquid for a hot-melt adhesive layer was prepared by melt-blending the materials of the formulation below.

| | |
|---|---|
| Ethylene-vinyl acetate copolymer resin (Evaflex EV40LX, trade name, produced by Mitsui DuPont Polychemical Co.): | 20 g |
| Terpene resin (Clearon M115, trade name, produced by Yasuhara Chemical K.K.): | 5 g |
| Ethylene wax (Neo-Wax L, trade name, produced by Yasuhara Chemical K.K.): | 2 g |

The above coating liquid was applied onto a glassine paper sheet (55GS, trade name, produced by Honshu Paper Co.) as a release sheet to form a hot-melt adhesive layer of 35 $\mu$m thick. The hot-melt adhesive layer had a melting point measured by DSC of 98° C., and melt viscosities of 19,300 cP, 15,000 cP, and 11,500 cP at 120° C., 150° C., and 170° C., respectively, as shown in Table 1.

Separately, a treatment liquid having the composition shown below was prepared for improvement of ink absorbency of the base sheet and water fastness of the image.

| | |
|---|---|
| Benzethonium chloride: | 5 parts |
| Polyallylamine hydrochloride: | 5 parts |
| Water: | 90 parts |

A cloth of 100% cotton for the base sheet in this Example was immersed sufficiently into the above treatment liquid containing the dye-fixing agent, taken out from the liquid, and dried to form an ink-receiving layer on a whole surface of the base sheet. The treated cotton cloth contained 5 g/m$^2$ of the dye fixing agent.

This treated cotton cloth was used as the base sheet having the ink-receiving layer throughout. The one face of this base sheet was brought into contact with the hot-melt adhesive layer face of the release sheet preliminarily prepared. The hot-melt adhesive layer and the base sheet were press-bonded together at 90° C. to prepare a heat-bondable ink-jet recording medium.

EXAMPLE 2

A coating liquid for a hot-melt adhesive layer was prepared by melt-blending the materials of the formulation below.

| | |
|---|---|
| Ethylene-vinyl acetate copolymer resin (Evaflex EV45LX, trade name, produced by Mitsui DuPont Polychemical Co.): | 20 g |
| Terpene resin (Clearon M105, trade name, produced by Yasuhara Chemical K.K.): | 10 g |

The above coating liquid was applied onto a glassine paper sheet (55GS, trade name, produced by Honshu Paper Co.) as a release sheet to form a hot-melt adhesive layer of 60 $\mu$m thick. The hot-melt adhesive layer had a melting point measured by DSC of 97° C., and melt viscosities of 25,500 cP, 18,000 cP, and 15,000 cP at 120° C., 150° C., and 170° C., respectively, as shown in Table 1.

The same cotton cloth as in Example 1 as the base sheet was brought into contact with the hot-melt adhesive layer obtained above. The hot-melt adhesive layer and the base sheet were press-bonded together at 90° C. to unify into a heat-bondable ink-jet recording medium.

EXAMPLE 3

A coating liquid for a hot-melt adhesive layer was prepared by melt-blending the materials of the formulation below.

| | |
|---|---|
| Ethylene-vinyl acetate copolymer resin (Evaflex EV260, trade name, produced by Mitsui DuPont Polychemical Co.): | 20 g |
| Terpene resin (Clearon M115, trade name, produced by Yasuhara Chemical K.K.): | 8 g |
| Wax (OX-020T. trade name, produced by Nippon Seiro Co.): | 2 g |

The hot-melt adhesive layer formed from the above coating liquid had a melting point measured by DSC of 103° C., and melt viscosities of 31,000 cP, 27,500 cP, and 20,000 cP at 120° C., 150° C., and 170° C., respectively, as shown in Table 1.

The same cotton cloth as in Example 1 was used as the base sheet. Onto one face of this base sheet, the above coating liquid to form a hot-melt adhesive layer of 50 $\mu$m thick. Further on the face of the hot-melt adhesive layer, a glassine paper sheet (55GS, trade name, produced by Honshu Paper Co.) was superposed as a release sheet. The release sheet and the hot-melt adhesive layer were press-bonded together to unify the base sheet, the hot-melt adhesive layer, and the release sheet to prepare a heat-bondable ink-jet recording medium of this Example.

EXAMPLE 4

The same hot-melt adhesive as in Example 2 was formed on the same release sheet as in Example 2. The base sheet used was a commercial Cloth (BJ Cloth FS-201, trade name, produced by Canon Inc.) having an ink-receiving layer. The base sheet was superposed on the above obtained hot-melt adhesive layer, and the both were press-bonded at 90° C. to unify the base sheet, the hot-melt adhesive layer, and the release sheet to prepare a heat-bondable ink-jet recording medium of this Example.

EXAMPLE 5

A film type hot melt adhesive of 80 μm thick (D-2230, trade name, produced by Kurabo Industries Ltd.) as the material for the hot-melt adhesive layer was superposed on one face of a glassine paper as the release sheet. Further, the same BJ Cloth FS-201 (trade name, produced by Canon Inc.) as in Example 4 was superposed on the above hot-melt adhesive layer. These were press-bonded together at 60° C. for unification to produce a heat-bondable ink-jet recording medium.

The film type hot-melt adhesive, D-2230, used in this Example had a melting point measured by DSC of 67° C., and melt viscosities of 500,000 cP, 150,000 cP, and 55,000 cP at 120° C., 150° C., and 170° C., respectively, as shown in Table 1.

EXAMPLE 6

On a BJ Cloth FS-201 (trade name, produced by Canon Inc.) as the base sheet, was superposed a film type hot-melt adhesive D-2230 of 80 pm thick (produced by Kurabo Industries Ltd.). Further thereon, a polyethylene terephthalate film of 100 μm thick was superposed. The superposed matter was press-bonded at 60° C. to unify it into a heat-bondable ink-jet recording medium of the present invention.

Comparative Example 1

A coating liquid for a hot-melt adhesive layer was prepared by melt-blending the materials of the formulation below.

| | |
|---|---|
| Ethylene-vinyl acetate copolymer resin (Evaflex 210ET, trade name, produced by Mitsui DuPont Polychemical Co.): | 20 g |
| Terpene resin (Clearon M115, trade name, produced by Yasuhara Chemical K.K.): | 18 g |
| Ethylene wax (Neo-Wax L, trade name, produced by Yasuhara Chemical K.K.): | 4 g |

The above coating liquid was applied onto a glassine paper sheet (55GS, trade name, produced by Honshu Paper Co.) as a release sheet to form a hot-melt adhesive layer of 35 μm thick. The hot-melt adhesive layer had a melting point measured by DSC of 98° C., and melt viscosities of 11,500 cP, 7,500 cP, and 3,000 cP at 120° C., 150° C., and 170° C., respectively, as shown in Table 1. Thus, the melt viscosity was lower than 10,000 cP at a temperature within the temperature range of from 120 to 170° C.

The same cotton cloth as in Example 1 as the base sheet was brought into contact with the hot-melt adhesive layer obtained above. The hot-melt adhesive layer and the base sheet were press-bonded together at 90° C. to unify into the heat-bondable ink-jet recording medium.

Evaluation

The heat-bondable ink-jet recording media prepared in Examples 1 to 6 and Comparative Example 1 were evaluated in the manner shown below with the evaluation standards shown below.

The heat-bondable ink-jet recording medium was cut into pieces of an A4-paper size, and was set on an ink-jet recording apparatus. A color image was formed on the ink-receiving layer of the heat-bondable recording medium by an ink-jet recording method by a commercial ink-jet printer (BJC-420J, trade name, manufactured by Canon Inc.).

Then the release sheet was peeled off from the heat-bondable ink-jet recording medium to bare the hot-melt adhesive layer. The hot-melt adhesive layer was pressed against a cloth sheet of 100% cotton to bring into close contact with it.

Then pressure was applied with an iron (IA-620T, trade name, manufactured by Hitachi Co., Ltd.) uniformly against the base sheet at the side of the formed image for 3 minutes at a heating temperature ranging from 180 to 210° C.

The images formed in the above manner were evaluated by the methods and the evaluation standards below. Image quality:

The formed image was observed visually. The image showing no bleed was evaluated as "A". The image showing bleed was evaluated as "B". Table 1 shows the evaluation results.

Fastness

The heat-bondable ink-jet medium bonded to the cloth of 100% cotton as a test piece was subjected to ten cycles of 10-minute washing and 10-minute rinsing by a two-tank type domestic washing machine, and was subsequently dried. Then, the test piece was evaluated visually for the fastness of the heat-bonded ink-jet recording medium on use.

The heat-bondable ink-jet recording medium which was not peeled at all was evaluated as "A", and the one which was peeled at least at one site was evaluated as "B". The one which was not frayed at all was evaluated as "A", and the one which was frayed at least at one site was evaluated as "B".

As shown above, the present invention provides a heat-bondable ink-jet recording medium which enables formation of high-quality images without ink flow or bleed by ink-jet printing, which can be heat-bonded readily domestically onto an adherend article of a variety of materials, and which has high fastness without causing fraying or peeling of the end portion even when it is used as a bonded label or a bonded emblem.

TABLE 1

Thermal Properties of Heat-Bondable Ink-Jet Recording Medium and Evaluation Results Thereof

| Example | Melting point (° C.) | Melt viscosity (cP) 120° C. | 150° C. | 170° C. | Image quality | Fastness Peeling | Fraying |
|---|---|---|---|---|---|---|---|
| 1 | 98 | 19,300 | 15,000 | 11,500 | A | A | A |
| 2 | 97 | 25,500 | 18,000 | 15,000 | A | A | A |
| 3 | 103 | 31,000 | 27,500 | 20,000 | A | A | A |
| 4 | 103 | 31,000 | 27,500 | 20,000 | A | A | A |
| 5 | 67 | 500,000 | 150,000 | 55,000 | A | A | A |
| 6 | 67 | 500,000 | 150,000 | 55,000 | A | A | A |

TABLE 1-continued

| Thermal Properties of Heat-Bondable Ink-Jet Recording Medium and Evaluation Results Thereof | | | | | | | |
|---|---|---|---|---|---|---|---|
| | Melting point (° C.) | Melt viscosity (cP) 120° C. | 150° C. | 170° C. | Image quality | Fastness Peeling | Fraying |
| Comparative Example | | | | | | | |
| 1 | 98 | 11,500 | 7,500 | 3,000 | B | B | B |

What is claimed is:

1. A heat-bondable ink-jet recording medium comprising a base sheet comprising a cloth or nonwoven fabric and having an ink-receiving layer, and, on a face of said base sheet opposite a face including said ink-receiving layer, an adhesive layer having a thickness ranging from 30 to 120 μm, a melting point of not higher than 110° C. as measured by DSC and a melt viscosity of not lower than 10,000 cP within a temperature range of from 120 to 170° C.

2. The heat-bondable ink-jet recording medium according to claim 1, wherein a release sheet is attached onto the adhesive layer.

3. The heat-bondable ink-jet recording medium according to claim 1, wherein the ink-receiving layer comprises a cationic substance.

4. The heat-bondable ink-jet recording medium according to claim 1, wherein the ink-receiving layer comprises porous particles.

5. The heat-bondable ink-jet recording medium according to claim 1, wherein the adhesive layer comprises a thermoplastic resin having a melt flow rate of not higher than 80.

* * * * *

UNITED STATES PATENT AND TRADEMARK OFFICE

CERTIFICATE OF CORRECTION

PATENT NO. : 6,432,514 B1
DATED : August 13, 2002
INVENTOR(S) : Motokazu Kobayashi et al.

It is certified that error appears in the above-identified patent and that said Letters Patent is hereby corrected as shown below:

Column 9,
Line 28, "pm" should read -- $\mu$m --.

Column 10,
Line 20, "Image" should read -- ¶Image --.
Line 27, "Fastness" should read -- Fastness: --

Signed and Sealed this

Twenty-second Day of July, 2003

JAMES E. ROGAN
*Director of the United States Patent and Trademark Office*